United States Patent [19]

Sherrill

[11] 4,023,805

[45] May 17, 1977

[54] TRICKY DISK

[76] Inventor: Harry Sherrill, 409 E. 6th St., Irving, Tex. 75060

[22] Filed: May 1, 1974

[21] Appl. No.: 466,077

[52] U.S. Cl. ..... 273/106 B; 46/74 D

[51] Int. Cl.² ..... A63H 27/00; A63B 65/10

[58] Field of Search ..... 273/106 B, 105.4; 46/74 D

[56] References Cited

UNITED STATES PATENTS

| | | | |
|---|---|---|---|
| 899,123 | 9/1908 | Mills | 273/105.4 |
| 2,211,244 | 8/1940 | Routledge | 273/105.4 |
| 3,594,945 | 7/1971 | Turney | 273/106 B X |
| 3,710,505 | 1/1973 | Linenfelser | 273/106 B X |
| 3,765,122 | 10/1973 | English | 46/74 D |

*Primary Examiner*—Paul E. Shapiro
*Attorney, Agent, or Firm*—Peter J. Murphy

[57] ABSTRACT

A flying toy is generally in the shape of an inverted bowl having a rim which is eccentrically weighted. A toy consists of the following concentric surface portions progressing radially inward from the rim: a slightly upwardly inclined aerodynamic surface, a more sharply upwardly inclined aerodynamic surface, a crest, and a downwardly inclined surface defining with a flat central floor and upwardly opening crater.

10 Claims, 2 Drawing Figures

TRICKY DISK

BACKGROUND AND SUMMARY OF THE INVENTION

This invention relates to a toy in the form of a disk having aerodynamic characteristics enabling it to sail through the air between a thrower and a catcher.

A principal object of this invention is to provide an aerodynamic toy of this type which, instead of being designed to perform a simple smooth flight pattern, is deliberately designed for a certain amount of erratic, unpredictable action in use.

Another important object of this invention is to provide an improved toy of this type which will perform unpredictable maneuvers adding to the alertness required of the users, and therefore making its use more interesting to the users.

These objects are accomplished in a device which is made up of a rim comprising inner and outer peripheral margins of circular shape, the inner margin being eccentrically positioned with respect to the outer margin to produce an eccentrically weighted rim of varying radial thickness. Concentric air deflecting surfaces are mounted on the rim including a first ring shaped surface mounted concentrically with the outer peripheral margin and extending inwardly and upwardly from the rim and a first angle of attack, and a second ring-shaped air-deflecting surface mounted concentrically with the external peripheral margin and extending inwardly and upwardly from the first air deflecting surface at a second greater angle of attack. A central concave surface is mounted to the inner edge of the second air-deflecting surface.

The novel features and the advantages of the invention as well as additional objects thereof, will be understood more fully from the following description when read in connection with the accompanying drawings.

DRAWINGS

FIG. 1 is a view from the top of the Tricky Disk, in the normal use orientation; and FIG. 2 is a diametral sectional view of the disk taken in the plane 2—2 of FIG. 1

DESCRIPTION OF THE PREFERRED EMBODIMENT

Figure 2:
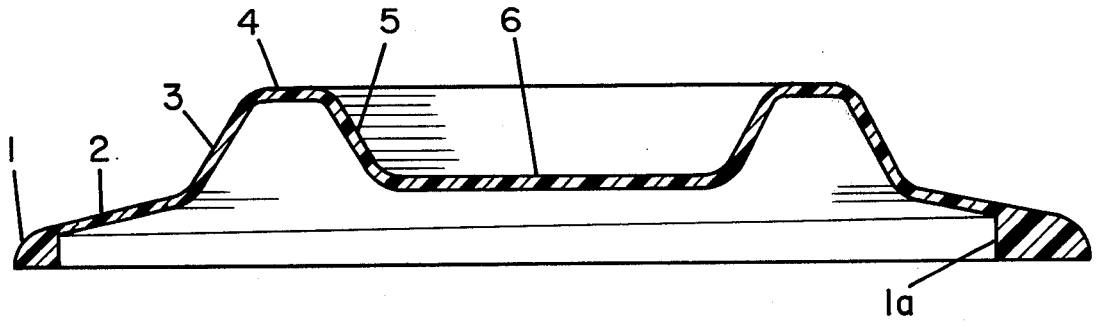

Referring to the drawings, the Tricky Disk is preferably molded from a plastic material, and has the general form of an inverted bowl. In use, the Tricky Disk is generally horizontal in use, as illustrated in FIG. 2, and is made up of the following generally concentric parts proceeding from the outer periphery toward the center: an outer rim 1, a slightly inclined aerodynamic surface 2, a more sharply inclined aerodynamic surface 3, a crest 4, and a downwardly inclined surface 5 which defines with a central horizontal surface a crater 6. In preferred form all of the above described portions and surfaces are circular and concentric with the outer periphery of the disk with the exception of the rim 1. Additionally, the rim 1 is not uniform in cross-section, varying from a minimum cross-section at the left side as viewed in FIG. 2 to a maximum cross-section at the right side as viewed in FIG. 2, with the rim therefore being eccentrically weighted. On function of the rim is that it provides greater strength, with limited rigidity, at the periphery of the disk to protect the disk from damage caused by striking objects in flights. Additional functions of the rim will be described subsequently.

Figure 1:
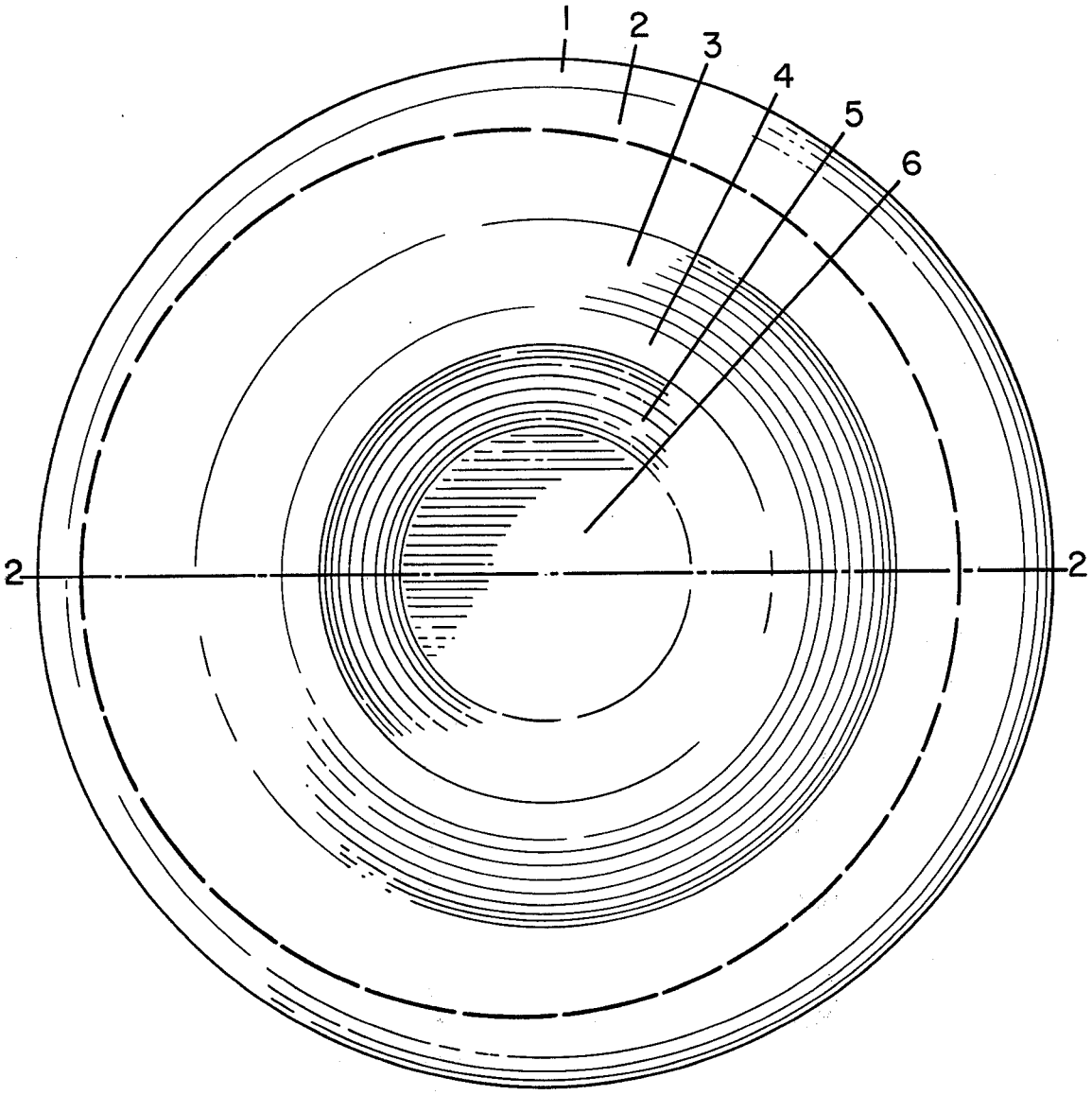

In the plan view, FIG. 1, and the cross-sectional view, FIG. 2, the outer surface of the rim 1 is seen to begin at the periphery of the TRICKY DISK, curving upward and inward, completing 85° of a circle. The inner surface of the rim 1 is perpendicular to the horizontal plane of the TRICKY DISK, as seen in the cross-sectional view, FIG. 3, with the inside circumference in an eccentric position with respect to the outer circumference, so that the thickness or horizontal dimension of the rim, 1 at the narrowest point on its base is one-half the thickness of the rim 1 at the opposite side of the TRICKY DISK.

Inclined as nearly as possible to 9.5° from the horizontal plane of the TRICKY DISK, upward and inward from the superior, convex surface of the rim 1, is a primary air-deflecting surface 2, which deflects the air into which the TRICKY DISK is traveling, toward a secondary air-deflecting surface 3, which is at an angle as near as possible to 54° medialward from the horizontal plane of the TRICKY DISK. The secondary air-deflecting surface 3 deflects the air upward and over the crest 4 of the TRICKY DISK.

At this point, another feature of the performance of the TRICKY DISK appears, explanation of which first requires further explanation of the features of its construction. The crest 4 of TRICKY DISK is elevated above the base plane at a ratio of 1.75 for the elevation of the crest 4 to 10.5 for the diameter of the tricky disk, as seen in both FIG. 2. The crest 4 is circular, centrally-positioned in the TRICKY DISK, with the ratio of the outer margin being 5.5 and the inner margin 4.75, compared to 10.5 for the diameter of the TRICKY DISK. The primary air-deflecting surface 2 blends into the secondary air-deflecting surface 3 and the secondary air-deflecting surface blends into the crest 4 of TRICKY DISK by curved surfaces of equal radius to the convex surface of the rim 1. Then, from the inner margin of the crest 4 the upper surface of TRICKY DISK descends downward and medialward by a curve identical to those described above, blending into a surface 5, which descends downward and medialward at an angle equal to but opposite in direction to the secondary air-deflecting surface 3. The surface 5 becomes the inner wall of the crest as well as the wall of a crater 6, centrally located in the TRICKY DISK, blending into the horizontal floor of the crater 6 by a curve identical to those previously described.

The floor of the crater 6 is elevated above the base plane of the rim 1 of the TRICKY DISK at a ratio of 0.75 for the elevation of the crater floor to 10.5 for the diameter of the TRICKY DISK. The ratio of the diameter of the floor of the crater 6, compares with the diameter of the TRICKY DISK by 3 to 10.5. Thus it is, that although the general aspect of TRICKY DISK is convex, as viewed from the top the crater 6 is concave.

In preferred size, the TRICKY DISK may vary from a diameter of approximately 7 inches to a diameter of approximately 12 inches, but with the proportions of its various parts as above described having a constant relation to each other, whatever the diameter, so as to preserve its performance characteristics.

OPERATION

The TRICKY DISK is launched into flight by being held in either hand, fingers curved under the rim 1, fingertips against the concave surface of the deflecting surface 2, thumb around the exterior portion of the rim 1, with the tip of the thumb on the convex surface of the deflecting surface 2. In use, the TRICKY DISK is thrown in a generally frontal direction away from the body, from a position near waist level, with a snapping motion of the wrist, in such a manner as to cause it to rotate in flight with its vertical axis more or less perpendicular with the surface of the playing field. The force with which the TRICKY DISK is launched and its physical attitude in relation to the surface of the playing field at the moment it is released will have some effect upon but not wholly determine its flight characteristics, as explained below.

The eccentricity of the rim 1 produces its second function. Being eccentrically positioned at its inner margin, the rim makes the flight of the TRICKY DISK completely different from that of other similar recreational devices. In flight, the TRICKY DISK travels with a wobbling motion in a plane consistent with its horizontal axis. This produces the third function of the rim, but which does not always occur, thereby making it necessary for the person to whom the TRICKY DISK is thrown to be alert for the unexpected, which contributes to the benefits and pleasures of its use.

The wobbling motion in flight sometimes causes the TRICKY DISK to tilt laterally, resulting in a yaw, or curved flight, right or left, depending upon which hand is used to launch it in flight. In turn, other features of the construction of the TRICKY DISK, which will be explained below, sometimes but not always cause a reversal of the tilt and yaw, reversing the curve of the flight path. Neither the person launching the TRICKY DISK nor the person receiving it can predict its flight pattern as it leaves the hand of the launcher. Sometimes the yaw occurs; sometimes it doesn't. The wobble in flight is always present.

After the TRICKY DISK is launched, the crater 6 performs the first of two functions. As the air is deflected by the secondary deflecting surface 3 and passes over the crest 4 an effect occurs similar to that produced by an airfoil and a vacuum effect occurs over the crater 6. If the TRICKY DISK has been launched with sufficient force, it will travel in the direction of launching a short distance and then, while still maintaining an attitude parallel to the surface of the playing field, it will swoop slightly upward in its flight path for a certain distance, depending on the force with which it was launched, then descend to the regular flight path, all the while continuing its wobbling, forward motion, sometimes tilting, sometimes not.

If the TRICKY DISK tilts during flight, the second function of the crater 6 occurs. As the TRICKY DISK tilts in flight, causing the laterally-curved flight path previously described, the air against which it moves laterally exerts pressure against the wall 5 of the crater 6 opposite to the curved direction of flight and causes the TRICKY DISK to again assume a position more-or-less level in flight—while continuing the forward, wobbling motion —whereupon the TRICKY DISK tilts slightly in a direction opposite to the original direction of tilt, the line of flight curving opposite to the original curved flight, and the TRICKY DISK descends to the surface of the playing field or is caught by the receiver.

If not launched with sufficient force, the TRICKY DISK will travel generally in the direction of launching, without either swooping upward or tilting in flight, with the regular wobbling motion. If thrown with slightly more force than that necessary to produce a simple forward flight path, a tilt and a curved flight path will occur but the pressure of the air against the opposite wall 5 of the crater 6 will not be sufficient to reverse the tilt of the TRICKY DISK and the original curved flight path away from the forward flight path is the only maneuver which occurs.

As can be seen from the above descriptions, the actions of the recreational device, the TRICKY DISK, are new and different when compared with those of any other recreational device which is used by being thrown or launched in one way or another. The TRICKY DISK, instead of being designed to perform a simple, smooth flight pattern, has been deliberately designed for a certain amount of erratic, unpredictable action in use. Neither the person launching the TRICKY DISK in flight nor the person attempting to receive it can predict with certainty what it will do, once it leaves the launcher's hand.

At the same time, none of the maneuvers of the TRICKY DISK are performed in such a gross manner as to be frustrating, but simply add to the alertness necessary in its use and make its use more interesting, as compared with the throwing of the average recreational device back and forth from person to person, which soon becomes monotonous and uninteresting. Any user of the TRICKY DISK will definitely have received some exercise and have achieved a good measure of recreation, after a few minutes of its use and, what is equally important, will look forward to using it again with pleasurable anticipation.

What is claimed is:

1. An aerodynamic device comprising;

a circular rim comprising inner and outer peripheral margins, the inner margin being eccentrically positioned with respect to the outer margin to form an eccentrically weighted rim of varying radial thickness;

air deflecting surfaces mounted on said rim comprising;

a ring shaped air-deflecting surface extending generally inwardly and upwardly from said rim, and a central surface mounted to the inner edge of said ring.

2. An aerodynamic device as set forth in claim 1 wherein said air-deflecting surfaces are concentric surfaces comprising: a first ring shaped air-deflecting surface mounted concentrically with the outer margin and extending inwardly and upwardly from said rim at a first angle of attack; and a second ring-shaped air-deflecting surface mounted concentrically with said external margin and extending inwardly and upwardly from said first air-deflecting surface at a second, greater angle of attack; and wherein said central surface is a concave surface.

3. An aerodynamic device as set forth in claim 2, wherein said rim defines a horizontal base plane for said device; and wherein the angle of attack of the first air-deflecting surface is about 9.5° and of the second air-deflecting surface is about 54°, relative to said base plane.

4. An aerodynamic device as set forth in claim 3, wherein the juncture of said second air-deflecting surface and said central concave surface defines an annular crest; wherein said crest is elevated from the base plane at a ratio of about 1.75 for the elevation of the crest to 10.5 for the outer diameter of said device; and wherein the ratio of the diameter of the outer margin of said crest is 5.5 and of the diameter of the inner margin of said crest is 4.75 as compared to 10.5 for the outer diameter of said device;

wherein said central concave surface has a planar horizontal floor; wherein said floor is elevated above said base plane at a ratio of 0.75 for the elevation of said floor to 10.5 for the outer diameter of said device; and wherein the ratio of the diameter of said floor compares with the overall diameter of said device by 3 to 10.5.

5. An aerodynamic device as set forth in claim 2, wherein the base of said rim defines a horizontal base plane for the device; wherein the juncture of said second air-deflecting surface and said central concave surface defines an annular crest; and wherein said crest is elevated from the base plane at a ratio of about 1.75 for the elevation of the crest to 10.5 for the outer diameter of said device.

6. An aerodynamic device as set forth in claim 5 wherein said central concave surface has a planar horizontal floor; and wherein said floor is elevated above said base plane at a ratio of 0.75 for the elevation of said floor to 10.5 for the outer diameter of said device.

7. An aerodynamic device as set forth in claim 5 wherein said concave surface includes a planar horizontal floor; and wherein the ratio of the diameter of the floor compares with the overall diameter of said device by 3 to 10.5.

8. An aerodynamic device as set forth in claim 2 wherein the base of said rim defines a horizontal base plane for the device; wherein the juncture of said second air-deflecting surface and said central concave surface defines an annular crest; wherein the ratio diameter of the outer margin of said crest is 5.5 and the diameter of the inner margin of said crest is 4.75 as compared to 10.5 for the outer diameter of said device.

9. An aerodynamic device as set forth in claim 8 wherein said crest is elevated above said plane at a ratio of 1.75 for the elevation of the crest to 10.5 for the outer diameter of said device.

10. An aerodynamic device as set forth in claim 1 wherein the radial thickness of said rim at its narrowest point is about one-half the thickness at its thickest point.

* * * * *